United States Patent [19]

Lubow et al.

[11] 4,235,144

[45] Nov. 25, 1980

[54] MEANS FOR CONTROLLING SPECIAL MUSICAL EFFECTS

[75] Inventors: Raymond Lubow, Hollywood; John R. Brand, Arcadia, both of Calif.

[73] Assignee: Tel-Ray Electronics Manufacturing Co., Inc., North Hollywood, Calif.

[21] Appl. No.: 46,017

[22] Filed: Jun. 6, 1979

[51] Int. Cl.[3] ..... G10H 3/00

[52] U.S. Cl. ..... 84/1.16; 84/1.24; 84/DIG. 30

[58] Field of Search ..... 84/1.14, 1.16, DIG. 30, 84/1.15, 1.24

[56] References Cited

U.S. PATENT DOCUMENTS

| | | | |
|---|---|---|---|
| 3,290,425 | 12/1966 | Stobaugh | 84/1.16 |
| 3,530,227 | 9/1970 | Wheeler et al. | 84/1.16 |
| 3,709,084 | 1/1973 | Stobaugh | 84/1.16 |

*Primary Examiner*—J. V. Truhe
*Assistant Examiner*—Forester W. Isen
*Attorney, Agent, or Firm*—Freilich, Hornbaker, Wasserman, Rosen & Fernandez

[57] ABSTRACT

A means for controlling special musical effects in synchronism with picking a string of a stringed musical instrument by a pick. More specifically, the disclosure describes a means whereby a signal generated as a result of a pick breaking contact with a string of the stringed instrument initiates a special musical effect. The special musical effect may alter the output of a pick-up generated by vibration of the strings, or may be independent of string vibration and merely initiated by the pick breaking contact with the string. Also, disclosed is a pick having a conductive portion and a nonconductive portion so that picking a string by the conductive portion initiates a special musical effect and picking the string by the nonconductive portion results in the instrument operating in a conventional manner without the special musical effect. A pick is also disclosed having two separate conductive portions and a nonconductive portion so that different effects can be achieved in accordance with which portion of the pick is used to pick the strings. Also disclosed is a pick means which can activate a special musical effect even though the strings of the stringed instrument are not conductive.

25 Claims, 9 Drawing Figures

MEANS FOR CONTROLLING SPECIAL MUSICAL EFFECTS

BACKGROUND OF THE INVENTION

The invention relates to musical instruments and more particularly to stringed instruments utilizing special musical effects.

Electric guitars and other stringed musical instruments frequently employ a pick-up of some type, an electrical signal from the pick-up being amplified and applied to a speaker. Frequently, these types of stringed instruments utilize a special musical effect generator in series with the output of the pick-up in order to alter its frequency response and/or amplitude characteristics. Typical special effects include those known in the musical arts as wah wah, phasing, flanging, distortion, compression, slow attack, percussive attack/decay, percussion instrument simulators, and the like. Conventional instruments provide control of special effect generators by knobs, foot switches, foot pedals and in some cases by preset signal levels or by a preset rate of automatic repetition. Use of hand or foot controls present various difficulties to the musician who generally uses both hands to operate the musical instrument and who may desire to move from a fixed position while playing. Foot controls also tend to be tiring when constantly pumped to produce certain musical effects, and extremely rapid musical effects are not physically possible. Preset signal level controls produce a special musical effect at only one preset level, and do not allow use of the full dynamic range of the instrument. Automatic repetition special effects limit the musician to one preset tempo which is often pleasing only for a limited time. The present invention solves the above described problems by providing a means for controlling special musical effect generators in synchronism with use of a pick means, and without requiring any other controls to be manipulated by the musician.

SUMMARY OF THE INVENTION

The invention provides a means for controlling a special musical effect means in synchronism with picking of a stringed musical instrument such as an electric guitar. A sensing means is provided which defines the state of contact between a pick means and one of the strings. A means responsive to the sensing means initiates the special musical effect means. In a specific embodiment, the special musical effect means is initiated at a time related to the breaking of contact between a conductive portion of the pick means and a conductive string. Picking or strumming of the strings by the fingers, a nonconductive pick, or a nonconductive portion of the pick means allows the musical instrument to respond in a manner unaffected by the special musical effect means. The invention also provides a means whereby a pick means having a plurality of non-interconnected conductive portions can be utilized to control a plurality of special musical effect generators, the special musical effect being determined by orientation of the pick means in the musician's hands so that different portions of the pick can be utilized to pick the strings. Examples of special musical effects described are wah wah, slow attack, percussive attack/decay, or repetitive effects. However, the invention is equally applicable to any type of special musical effect which can be utilized in conjunction with electric guitars or the like.

In addition, the invention provides a means so that different musical effects can be initiated after a predetermined number of contacts between the pick means and the string. Thus, a first special musical effect generator is activated until a first predetermined number of contacts between the pick and a string has been made, and then another special musical effect generator is activated until a second predetermined number of contacts has been made at which time a third special musical effect is activated, and so on. In addition, the invention provides a pick means having two electrically isolated portions adapted so that contact between the pick and a string will cause the two portions to make conductive contact with each other. Breaking contact between the pick and the string will break the conductive contact, thereby initiating the special musical effect. Thus, the pick means as above-described can be utilized in an instrument having nonconductive strings. Also, it should be recognized that the special musical effect means initiated need not necessarily be auditory, and the pick means could be utilized for control of non-auditory devices such as light devices.

DETAILED DESCRIPTION

Detailed illustrative embodiments of the invention disclosed herein exemplify the invention and are currently considered to be the best embodiments for such purposes. However, it is to be recognized that many types of special effect generators other than those specifically mentioned can be controlled by removal of a pick from a string. Accordingly, the specific embodiments disclosed are representative in providing a basis for the claims which define the scope of the present invention.

As previously explained, the invention provides a means for synchronizing use of a special musical effect means in conjunction with use of a pick means for picking or strumming a stringed musical instrument. A means is provided for sensing the breaking of contact between the pick means and a string on the instrument, this contact breaking being used to activate a special musical effect means. The special effect is thus initiated in precise synchronism with use of the pick means. Different pick configurations are disclosed, so that different special musical effects can be initiated in accordance with which portion of the pick is used for picking the string. Picks are disclosed which can be utilized with instruments having both conductive and non-conductive strings. In a further embodiment of the invention, a counter is provided whereby different special musical effects can be introduced after a predetermined number of contacts between the pick and the string have occurred.

Figure 1:
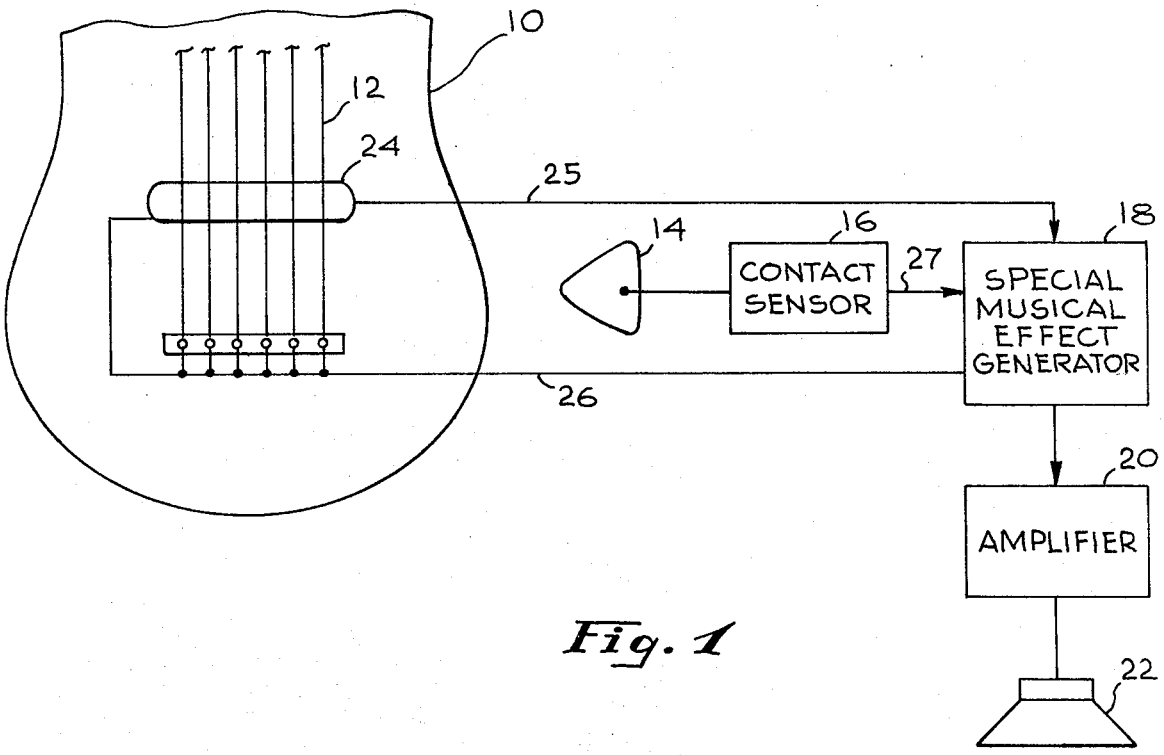
FIG. 1 is a diagrammatic representation of a stringed instrument and a special effect controlling means provided by the invention.

Referring now to FIG. 1, a musical instrument 10 having a plurality of strings 12, such as an electric guitar or the like, is shown. A pick 14 is provided for picking the strings 12, and a contact sensor or sensing means 16 is provided for providing a signal whose voltage state defines the state of contact between the pick 14 and the string 12. A special musical effect generator 18, as will be explained in detail below, either generates or modifies a signal to be amplified. This signal is supplied to an amplifier 20 which in turn drives a speaker 22. A pick up 24 located below the strings 12 provides an output or electrical signal on an output line 25 to the special effect generator 18, the electrical signal being related to the magnitude and frequency of string vibrations. In addition, all of the strings 12 are formed of a conductive material and interconnected electrically to a return line 26 to the special effect generator 18. Although in this particular embodiment, the strings 12 are conductive, another embodiment can utilize nonconductive strings as will be explained in further detail below.

The contact sensor 16 is configured so that a voltage potential on its output line 27 indicates whether or not the pick 14 is in electrical contact with the string 12. When the pick 14 breaks electrical contact with the string 12, an indication is provided to the special effect generator 18 which, in response thereto, initiates a special musical effect. Types of special musical effects which can be initiated upon breaking of contact between the pick 14 and the string 12 are many and varied. A few examples would include an attack or a slow attack special effect, a single special effect unrelated to the particular string being picked by the pick, or a single or repetitive type special effect having a predetermined amplitude and/or frequency profile occurring after initiation of the special effect, the characteristics of the special effect also being related to the vibrational characteristics of the particular string being picked by the pick 14. The predetermined amplitude and/or frequency profile is referred to hereinafter as an altering profile. As will be readily appreciated by one familiar with stringed instrument special effects, a special effect whose initiation occurs in synchronism with breaking of contact between the pick and the string provides a consistency of sound unachievable by conventional electric guitar systems.

Figure 2:
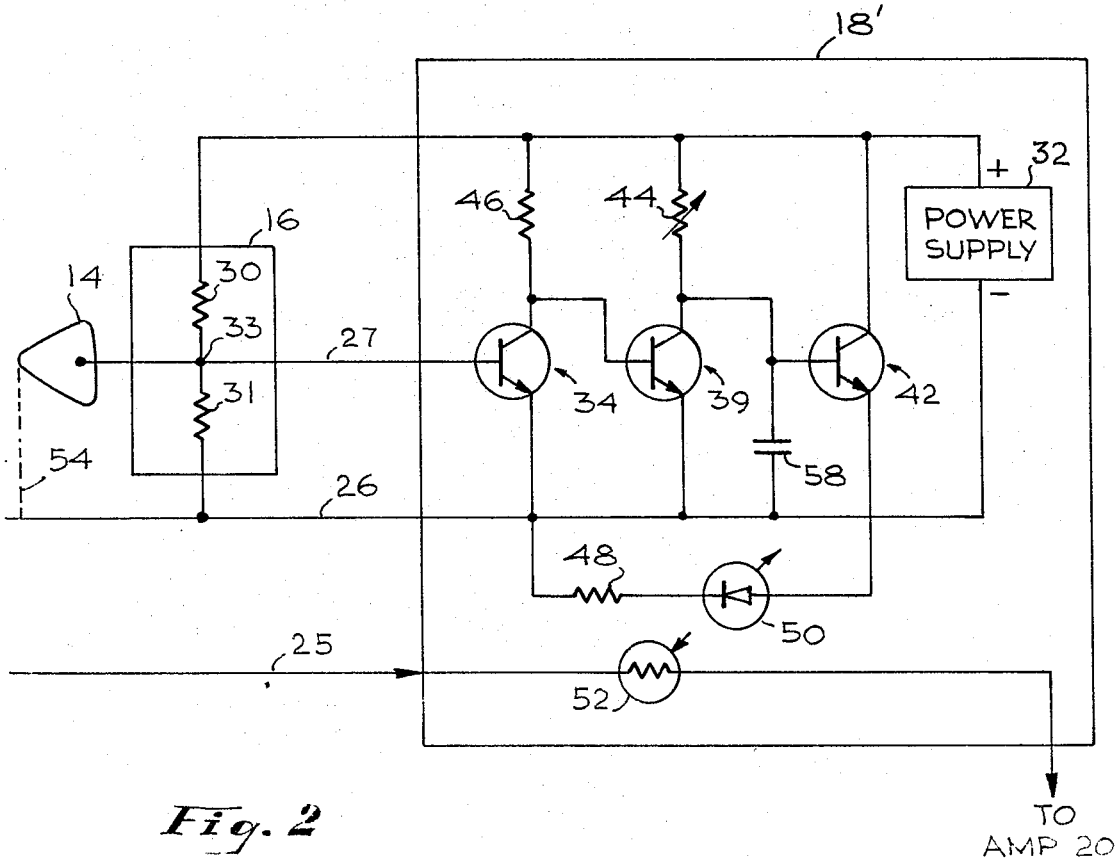
FIG. 2 is a schematic diagram showing a slow attack special effect generator controlled in accordance with the invention.

By way of example of a special musical effect generator which can be utilized in accordance with the invention, a slow attack generator 18' is shown in FIG. 2. Referring to FIG. 2, the contact sensor 16 includes a first resistor 30 and a second resistor 31 connected in series across the output of a power supply 32. The two resistors 30 and 31 are interconnected at a connection point 33, the voltage potential of which is determined by the value of the two resistors 30 and 31, and the output potential of the power supply 32. The connection point 33 is connected to the pick 14 and the base terminal of a first transistor 34. The first transistor 34 is conductive because of the positive voltage at its base terminal. Since the first transistor 34 is conductive, the base terminal of a second transistor 39 is at a low voltage potential because of the low voltage potential at the collector terminal of the first transistor 34, thereby resulting in the second transistor 38 being in a non-conducting state. The positive voltage at its collector terminal is applied to the base of a third transistor 42 causing it to be in a conducting state. With the third transistor 42 in a conducting state, a light emitting diode 50 is on due to the current flowing through the third transistor 42 and a dropping resistor 48. The light emitting diode 50 irradiates a light dependent resistor 52, thereby reducing its resistance to a minimum value and allowing an electrical signal appearing on the pick-up output line 25 to pass substantially unattenuated to the amplifier 20. When the pick 14 touches a string 12, as represented by the dotted line shown at 54, the base electrode at the first transistor 34 is shorted to the return line 26, thereby cutting off the first transistor 34. This cutoff of the first transistor 34 causes the voltage at its collector terminal to increase, thereby turning on the second transistor 39. When the second transistor 39 is turned on, a control capacitor 58 discharges through the second transistor 39 to ground, thereby biasing the third transistor 42 off. This cuts off the current through the light emitting diode 50 and causes the light dependent resistor 52 to increase in resistance and greatly attenuate the electrical signal from the pickup output line 25. When the pick 14 is removed from the string 12, the voltage at the base electrode of the first transistor 34 rises, thereby causing it to conduct and cutting off the second transistor 39. As soon as the second transistor 39 is cut off, a charge on the control capacitor 58 begins to build up, the rate of charge build-up depending on the value of variable resistor 44. As the voltage across the control capacitor 58 increases, the voltage at the emitter of the third transistor 42 increases, thereby increasing the current through and light output of the light emitting diode 50, and reducing the resistance of the light dependent resistor 52. As the light output of the light emitting diode 52 increases, the amplitude of the electrical signal reaching the amplifier 20 increases, thereby providing a special musical effect which is known as slow, bowed string, or accordian attack. Thus, as one can appreciate, during the time that the pick 14 touches one of conductive strings 12, any output from the pick-up 24 is blocked from the amplifier 20 because of the high impedance of the light dependent resistor 52. However, as soon as the pick 14 is removed from the string 12, a charge on the control capacitor 58 begins to build up, the rate of charge build-up determining an attenuation profile of the light dependent resistor 52. Although the means for altering the output of the pickup 24 has been shown as a light emitting diode 50 and a light dependent resistor 52, this altering means could be replaced by an operational transconductive amplifier or any other type of device which in effect would alter the characteristics of the pick-up 24 output in accordance with the charge build-up across a capacitor. Also, as can be appreciated, the discharge of the control capacitor 58 through the second transistor 39, when the pick 14 makes conductive contact with the string 12, allows the control capacitor 58 to begin its charge build-up from the same initial condition each time conductive contact is broken. This initiation of the special effect at the same charge level of the control capacitor 58 each time conductive contact is broken provides a means for synchronizing the auditory characteristics of the special effect with pick removal.

Figure 3:
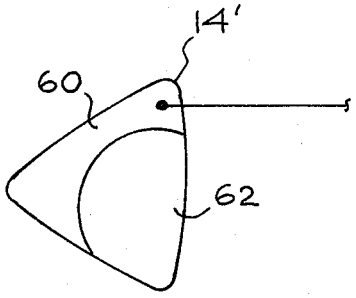
FIG. 3 is a plan view of a pick having conductive and non-conductive portions for controlling a special effect generator.

The circuit of FIG. 2 also allows the musical instrument 10 to operate in a conventional manner when the strings 12 are picked in a manner so that the interconnection point 33 is not shorted to the return line 26. In such a case, the special effect generator 18' would not alter or attenuate the electrical signal from the magnetic pickup 24, and it will pass directly through the light dependent resistor 52 to the amplifier 20. Referring to FIG. 3, use of the special effect generator 18' shown in FIG. 2 could be effected by a pick 14' having a first portion 60 formed of an electrically conductive material and a second portion formed of a non-conductive material 62. Thus, if the pick first portion 60 is used to pick the string 12, the slow attack special effect as above described will be initiated. However, if the pick were slightly re-oriented in the musician's hand so that the second portion 62 is used to pick the string 12, then the base of the first transistor 34 would not be shorted and the light dependent resistor 52 will be unaffected. Thus, a means has been provided whereby a slight reorientation of the pick 14' can allow the musician to select or not select the special effect at will.

Figure 4:
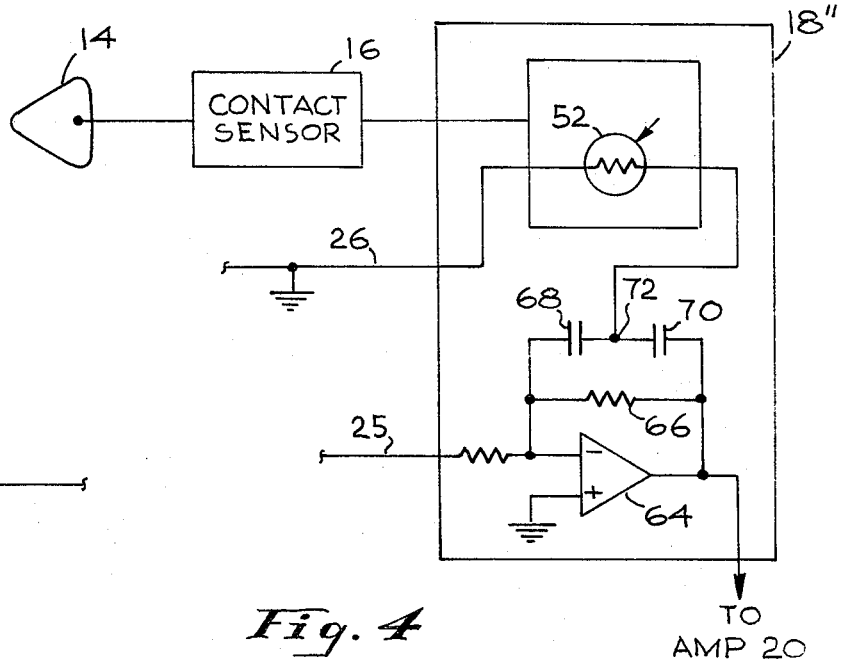
FIG. 4 is a partial schematic diagram showing a wah wah special effect generator controlled in accordance with the invention.

Another special effect generator 18'' for obtaining a special effect known as wah, or wah wah is shown in FIG. 4. Here, the light dependent resistor 52 is controlled in a manner identical to that previously described in conjunction with the first special effect generator 18'. The inverting amplifier 64 is configured to have a first feedback capacitor 68 and a second feedback capacitor 70. A common point 72 between the first and second feedback capacitors 68 and 70 connects to the light dependent resistor 52, the other side of which is connected to ground. At the time the pick 14' makes electrical contact with the string 12, this common point 72 between the first and second feedback capacitor 68 and 72 is essentially isolated from ground due to the high impedance of the light dependent resistor 52 as previously explained. As the impedance of the light dependent resistor 52 decreases, the characteristics of the feed back loop change, thereby creating the special musical effect known as wah.

Figure 5:
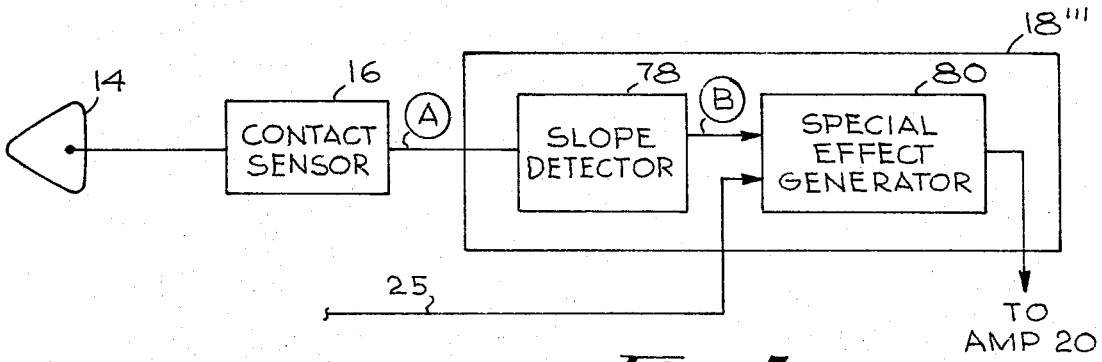
FIG. 5 is a block diagram showing a special effect generator initiated by a pulse generated as a result of the pick breaking contact with the string.

Another kind of special musical effect means 18''' is shown in FIG. 5. Here, the conductive pick 14 is attached to the contact sensor 16 as previously described. The special musical effect means 18''' includes a slope detector 78 and a special effect generator 80 of a type requiring a single pulse for initiation. Examples of such a special effect would include a specific musical tone or tonal pattern unrelated to the output of the string being picked, such as a drum or percussion type special effect; or a repetitive type special effect such as a repetitive percussion effect which begins as soon as the pick 14 is removed from the string and whose characteristics are related to the characteristics of the electrical signal from the magnetic pick up 24.

Figure 6:
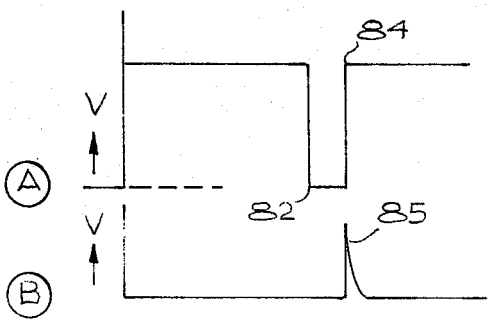
FIG. 6 is a waveform diagram showing signals at various points in the block diagram of FIG. 5.

Operation of the special effect means 18''' can be understood by referring to FIG. 6. Here, the output of the contact sensor 16 is merely the voltage appearing at the connection point 33, this voltage being shown in waveform A. The voltage drops to zero as shown at 82 each time the pick 14 makes conductive contact with the string 12, and returns to its original value as shown at 84 when the pick 14 breaks contact with the string 12. The slope detector 78 is chosen so that an upward voltage input provides a pulse output 85 this waveform being shown in waveform B. Thus, a pulse 85 is provided to the special effect generator 80 whenever the pick 14 is removed from the string 12. This pulse 85 shown in waveform B can initiate any kind of special effect as above described.

Figure 7:
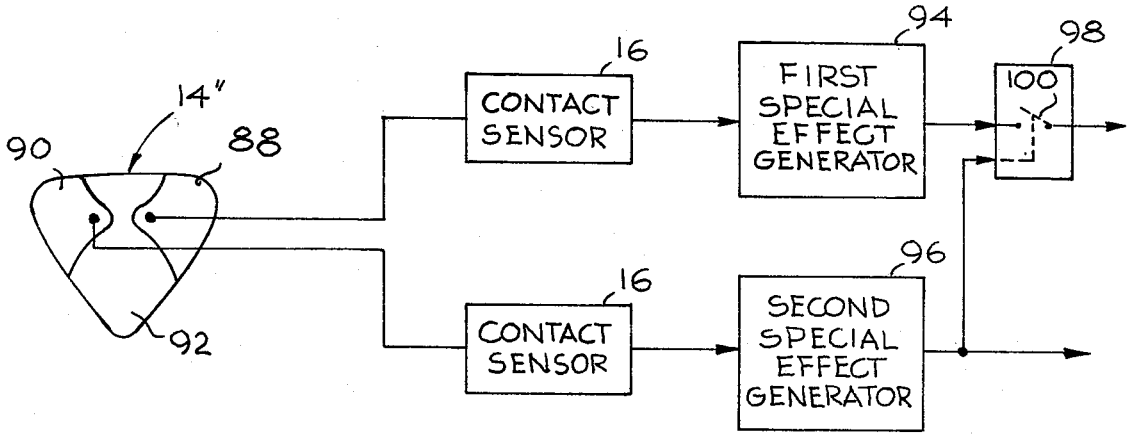
FIG. 7 is a plan view of a pick having two conductive portions and a non-conductive portion, and a block diagram showing control of corresponding special effect generators.

Having thus described various types of special musical effect generators, a pick means for utilizing one of a plurality of special effect generators will be shown. Referring to FIG. 7, another pick configuration 14'' is shown having a first conductive portion 88, a second conductive portion 90 and a nonconductive portion 92. The first conductive portion 88 is connected to a contact sensor 16 which in turn controls a first special effect generator 94 which could be of the type described in conjunction with FIG. 2 or FIG. 4. The second conductive portion 90 is connected through another contact sensor 16 to a second special effect generator 96 which could be of the type described in conjunction with FIG. 5. Thus, a pick 14''' could be utilized to initiate one type of special effect when the first conductive portion 88 is used to pick the strings 12, another type of special effect when the second conductive portion 90 is used, or no special effect when the nonconductive portion 92 is used. If one of the special effect generators is of the type described in FIG. 2 or 4, it may be desired to block its output in the presence of an output from the other special effect generator because its light dependent resistor 52 is normally in a low impedance state. To eliminate a possibility that two special effect generators could be driving the amplifier 20 at the same time, a blocking circuit 98 is shown, the circuit 98 being of the type that a signal appearing on the output line on the second special effect generator 96 will open a switch as shown at 100, thereby disconnecting the output of the first special effect generator 94. Although the blocking circuit 98 is shown functionally as a switch, there are numerous circuits which could be utilized to block the output of the first special effect generator 94 in the presence of an output from the second special effect generator 96. Although not shown, it can be readily appreciated that the nonconductive portion 92 of the pick 14''' could comprise a third conductive portion whereby three special effect generators could be controlled by the same pick, and the blocking circuit 98 modified so that whenever a signal from one of the special effect generators is provided, signals from the other two special effect generators will be blocked. Thus, a musician through orientation of the pick could utilize any one of three special effects.

Figure 8:
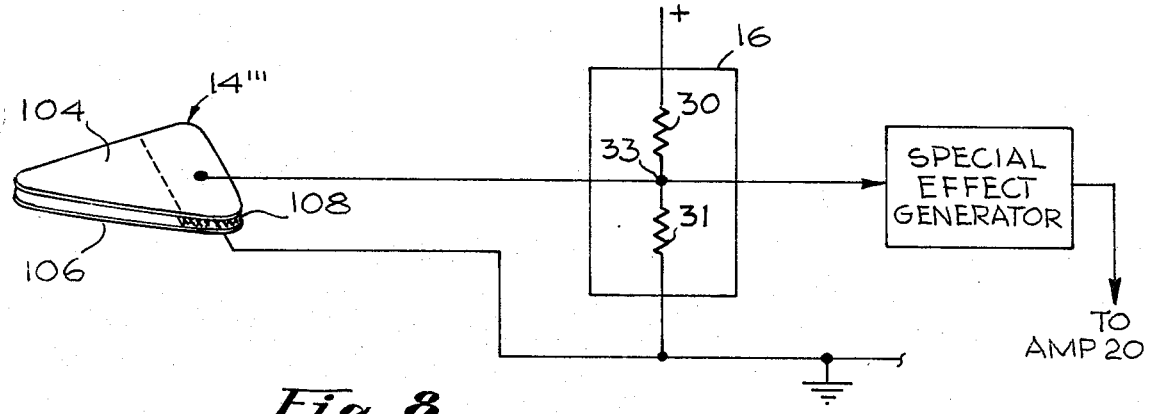
FIG. 8 is a perspective view of a pick having two spaced-apart electrically isolated conductive portions to be used with a stringed instrument having non-conductive strings.

FIG. 8 shows another configuration of the pick 14''' in which first and second conductive portions, 104 and 106, respectively, are electrically separated by an insulating portion 108. This type of pick can be utilized in conjunction with a stringed instrument having non-conductive strings. The first conductive portion 104 is connected to the connection point 33 in the contact sensor 16 and the second conductive portion 106 is connected to a return line. The conductive portions 106 and 108 are formed of a flexible material so that when contact is made between one portion and a string, it will be deformed so as to make electrical contact with the other portion, and will return to its original configuration when contact with the string is broken. When the nonconductive string is picked by the pick 14''', the two conductive portions 104 and 106 of the pick in contacting each other, short the connection point 33 to the return line and initiate a special effect as previously described. Thus, as one can appreciate, the invention can be utilized by stringed instruments having both conductive and nonconductive strings.

Figure 9:
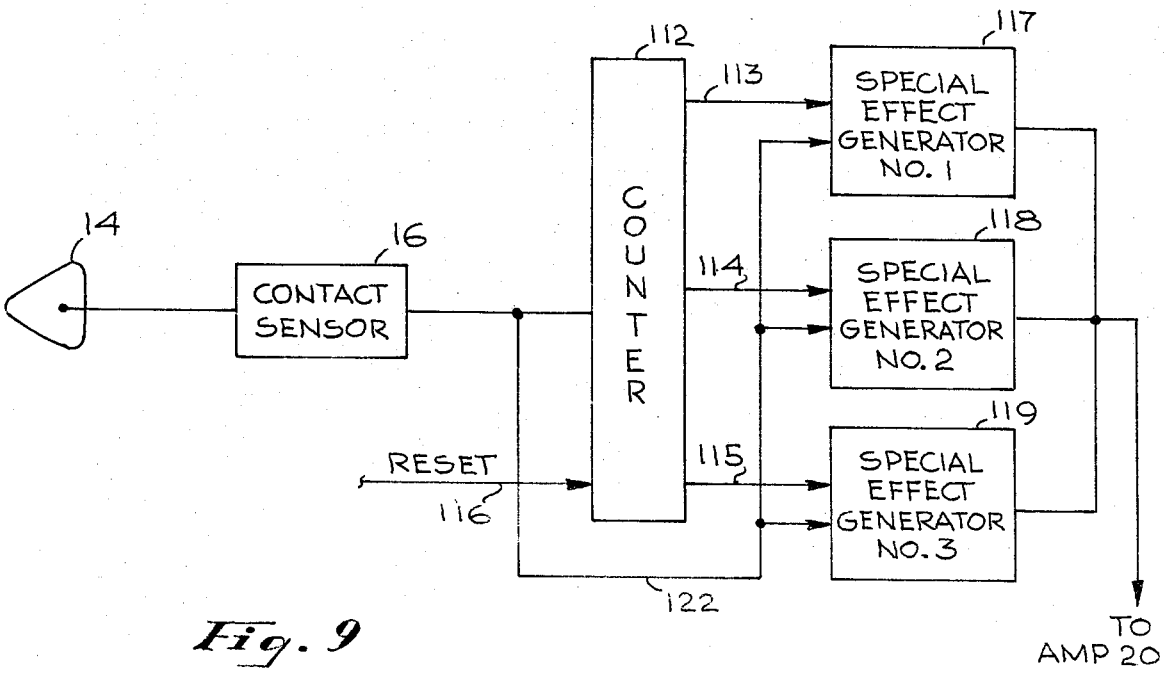
FIG. 9 is a block diagram showing an electronic counter used to sequentially initiate a plurality of special effect generators.

A further embodiment of the invention can be seen in FIG. 9 wherein a plurality of special effect generators can be utilized, each being activated after a first predetermined number of contacts between the pick and any of the musical instrument strings and deactivated after a second predetermined number of contacts. Referring to FIG. 9, the pick 14 is connected through the contact sensor 16, as previously described, to an electronic counter 112. The counter 112 is chosen so that activation signals appearing on first, second and third activation lines 113, 114 and 115, respectively, will be initiated and terminated at predetermined counts of the counter 112. A reset line 116 is provided so that the counter can be initialized by the musician. Three special effect generators 117, 118 and 119 are provided, each being connected to a corresponding activation line 113, 114 and 115. In operation, a pulse from the contact sensor 16 indexes the electronic counter 112 which in turn provides activation signals on the activation lines at predetermined count increments. The activation signals could activate their associated special effect generators in a variety of ways, one being to turn power on. The activated special effect generator then responds to the signal from a contact sensor output line 122 as previously explained.

As one can now appreciate from the above description, a means for controlling special musical effects has been disclosed wherein breaking of contact between a pick and a string initiates a variety of musical effects. In addition, different picks have been described wherein different special musical effects or no special musical effect can be obtained through orientation of the pick in the musician's hand. Also, a means is described whereby the special musical effect initiated is related to the number of times the pick picks a string on the instrument. Thus, a new, versatile means has been described wherein a variety of musical effects can be controlled by and in synchronism with the normal use of a pick.

What is claimed is:

1. Means for generating a special musical effect in synchronization with use of a musical instrument having one or more strings, said generating means comprising:

a special musical effect means comprising means for altering an electrical signal related to the frequency and amplitude of vibration of at least one of said one or more strings in accordance with a predetermined altering profile;

a pick means;

sensing means for determining when contact is broken between said pick means and one of said one or more strings; and initiating means responsive to said sensing means for causing said special musical effect means to alter said electrical signal in accordance with said predetermined altering profile.

2. The means for generating of claim 1 wherein said musical instrument includes pick-up means for providing said electrical signal related to the frequency and amplitude of vibration of at least one of said one or more strings, and said sensing means comprises means for providing a sensing pulse whose leading and trailing edges are related to said pick means making and breaking contact with one of said one or more strings, respectively, and said initiating means comprises means for causing said special musical effect means to initiate said predetermined altering profile at a time related to the time said pick means breaks contact with a contacted string.

3. The means for generating of claim 2 wherein said predetermined altering profile is related to a charge accumulation on a capacitor initiated by said sensing pulse trailing edge.

4. The means for generating of claim 3 wherein said special effect means comprises means for synchronizing predetermined characteristics of said predetermined altering profile with the time said pick means breaks contact with said string.

5. The means for generating of claim 2 wherein said special effect means comprises means for generating an attack or wah wah special effect.

6. The means for generating of claim 2 wherein said special musical effect means predetermined altering profile comprises a non-repetitive profile initiated when said pick means breaks contact with a contacted string.

7. The means for generating of claim 2 wherein said special musical effect means predetermined altering profile comprises a repetitive profile initiated when said pick means breaks contact with a contacted string.

8. The means for generating of claim 1 wherein said special effect means comprises a plurality of special effect generators, said means for generating further comprising:

and electronic counter having a plurality of output lines each connected to one of said special effect generators;

means for indexing said counter at a time related to the time said pick means makes or breaks contact with one of said one or more strings; and means for sequentially activating and deactivating each of said plurality of special effect generators in accordance with signals provided by said electronic counter, said signals being generated at predetermined indexing increments in accordance with the number of times said pick means contacts one of said one or more strings.

9. The means for generating of claim 1 wherein said pick means comprises:

a first electrically conductive portion;

a second electrically conductive portion spaced apart and electrically isolated from said first portion, said second portion adapted to make electrical contact with said first portion when said second portion picks one of said strings; and said sensing means comprises means for determining when said pick means first portion is in electrical contact with said pick means second portion, thereby indicating a state of contact between said pick means and one of said strings.

10. The means for generating of claim 1 wherein said musical instrument includes pickup means for providing said electrical signal related to the frequency and amplitude of vibration of at least one of said one or more strings, said pick means comprising:

a first portion formed of an electrically conductive material;

a second portion formed of an electrically non-conductive material; and said sensing means comprises a means for providing a first sensing pulse whose leading and trailing edges are related to said pick means first portion making and breaking contact with one of said one or more strings, respectively; and said initiating means comprises means responsive to said sensing means for causing said special musical effect means to initiate said predetermined altering profile at a time related to the time said pick means first portion breaks contact with a contracted string, thereby allowing said musical instrument to operate in a conventional manner when said pick means second portion makes or breaks contact with one of said one or more strings.

11. The means for generating of claim 10 wherein:

said special musical effect means further comprises means for altering said electrical signal related to the frequency and amplitude of vibration of at least one of said one or more strings in accordance with another predetermined altering profile;

said pick means further comprises a third portion formed of an electrically conductive material electrically isolated from said pick means first portion;

said sensing means further comprises means for providing a second sensing pulse whose leading and trailing edges are related to said pick means third portion making and breaking contact with one of said one or more strings; respectively; and said initiating means further comprises means responsive to said sensing means for causing said special musical effect means to initiate said another predetermined altering profile at a time related to the time said pick means third portion breaks contact with a contacted string.

12. The means for generating of claim 11 further comprising means for blocking any special musical effects not associated with said first, second or third pick portions breaking contact with one of said one or more strings.

13. In combination with a stringed musical instrument having a plurality of strings and a pickup means providing an electrical signal responsive to vibrations of one or more of said musical instrument strings, a special musical effect means for altering said electrical signal in accordance with a predetermined altering profile, and an amplifier for driving a speaker in response to said altered electrical signal, a means for controlling said special musical effect means comprising:

a pick means means for determining when said pick means breaks contact with one of said musical instrument strings; and means for initiating said predetermined altering profile at a predetermined time in relation to the time said pick means breaks contact with said string.

14. The means for controlling of claim 13 wherein said means for determining comprises:

a first resistor;

a second resistor connected to said first resistor at an interconnection point;

means for applying a voltage potential across said first and second resistor combination, thereby causing said interconnection point to be at a first voltage potential;

means for providing electrical contact between said interconnection point and said pick means; and means for altering the voltage of said interconnection point when said pick means is in contact with said string.

15. The means for controlling of claim 14 wherein said strings and pick means are formed of a conductive material and said strings are at a second voltage potential different from that of said first voltage potential whereby said interconnection point is at said first voltge potential when said pick means is not in contact with said string and at said second voltage potential when said pick means is in contact with said string.

16. The means for controlling of claim 15 wherein said pick means comprises first and second electrically isolated portions, said first portion being electrically conductive and connected to said interconnection point, and said second portion being electrically conductive and at said second voltage potential, said first and second portions being adapted so that when a string is picked by either said first or second portion, the pick portion contacting said string will be sufficiently deformed to be in electrical contact with the other pick portion, thereby altering the voltage at said interconnection point, and when said pick portion contacting said string breaks contact with said string, said contacting pick portion will return to its original position relative to the other pick portion, thereby resulting in said interconnection point returning to said first voltage potential.

17. The controlling means of claim 15 or 16 wherein said means for initiating comprises means for blocking said electrical signal from said amplifier when said voltage at said interconnection point is at said second voltage potential and unblocking said electrical signal when said interconnection point returns to said first voltage potential, thereby allowing said special musical effect means to alter said electrical signal.

18. The controlling means of claim 17 wherein said special musical effect means alters said electronic signal in a manner related to a charge on a control capacitor which is initiated when said interconnection point voltage changes from said second potential to said first potential.

19. The controlling means of claim 13 wherein said special musical effect means comprises two or more special effect generators, said pick means comprises a plurality of electrically conductive portions each connected to one of said special effect generators, each of said electrically conductive portions being electrically isolated from said other electrically conductive portions, said means for determining comprises means for determining when each of said conductive portions makes and breaks contact with said string; and said means for initiating comprises means for altering said electrical signal by said special effect generator associated with said pick conductive portion breaking contact with said string.

20. A method for controlling a special musical effect means for altering an electrical signal generated by a vibrating string of a stringed instrument in accordance with a predetermined altering profile, said method comprising the steps of:

determining a time when contact is broken between a pick and one of said stringed instrument strings; and initiating said predetermined altering profile at a time related to said time when said string and pick contact is broken.

21. Means for generating a special musical effect in synchronization with use of a musical instrument having one or more strings and being of the type having a pickup means for providing an electrical signal related to the amplitude and frequency of at least one of said strings, said means for generating comprising:

pick means comprising a first portion formed of an electrically conductive material, a second portion formed of an electrically nonconductive material, and a third portion formed of an electrically conductive material electrically isolated from said pick means first portion;

sensing means comprising means for providing a first sensing pulse whose leading and trailing edges are related to said pick means first portion making and breaking contact with one of said one or more strings, and a second sensing pulse whose leading and trailing edges are related to said pick means third portion making and breaking contact with one of said one or more strings;

first means for generating a first special musical effect;

second means for generating a second special musical effect;

first initiating means responsive to said first sensing pulse for initiating said first special musical effect when said pick means first portion breaks contact with one of said one or more strings;

second initiating means responsive to said second sensing pulse for initiating said second special musical effect when said pick means third portion breaks contact with one of said one or more strings; and means for allowing said musical instrument to operate in a conventional manner when said pick means second portion makes or breaks contact with one of said one or more strings.

22. The controlling means of claim 21 further comprising means for blocking any special musical effects not associated with a pick portion breaking contact with one of said one or more strings.

23. Means for controlling a special musical effect means in synchronization with use of a musical instrument having one or more strings, said special musical effect means comprising a plurality of special effect generators, said controlling means comprising:

a pick means;

sensing means for determining a state of contact between said pick means and one of said one or more strings;

an electronic counter having a plurality of output lines each connected to one of said special effect generators;

means responsive to said sensing means for indexing said counter at a time related to the time said pick means makes or breaks contact with one of said one or more strings; and means for sequentially activating and deactivating each of said plurality of special effect generators in accordance with signals provided by said electronic counter, said signals being generated at predetermined indexing increments in accordance with the number of times said pick means contacts one of said one or more strings.

24. Means for controlling a special musical effect means in synchronization with use of a musical instrument having one or more strings, comprising:

pick means comprising a first electrically conductive portion and a second electrically conductive portion spaced apart and electrically isolated from said first portion, said second portion adapted to make electrical contact with said first portion when said second portion picks one of said one or more strings;

sensing means for determining when said pick means first portion is in electrical contact with said pick means second portion, thereby indicating a state of contact between said pick means and one of said one or more strings; and initiating means responsive to said sensing means for activating said special musical effect means.

25. In combination with a stringed musical instrument having one or more strings and a pick up means providing an electrical signal responsive to vibrations of at least one of said one or more strings, a special musical effect means comprising a plurality of special effect generators for altering said electrical signal, and an amplifier for driving a speaker in response to said altered electrical signal, a means for controlling said special musical effect means comprising:

pick means comprising a plurality of electrically conductive portions each of which is connected to one of said special effect generators, each of said electrically conductive portions being electrically isolated from the other of said electrically conductive portions;

means for determining when each of said electrically conductive portions makes and breaks contact with one of said one or more strings; and means for initiating said musical effect means at a predetermined time in relation to the time one of said pick means conductive portions breaks contact with one or said one or more strings, said means for initiating comprising means for altering said electrical signals by said special effect generator associated with said pick means conductive portion breaking contact with one of said one or more strings.

* * * * *